US011306719B2

(12) United States Patent
Jeon et al.

(10) Patent No.: US 11,306,719 B2
(45) Date of Patent: Apr. 19, 2022

(54) COMPRESSOR

(71) Applicant: LG Electronics Inc., Seoul (KR)

(72) Inventors: Nayoung Jeon, Seoul (KR); Taekyoung Kim, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 275 days.

(21) Appl. No.: 16/444,369

(22) Filed: Jun. 18, 2019

(65) Prior Publication Data

US 2019/0383288 A1 Dec. 19, 2019

(30) Foreign Application Priority Data

Jun. 18, 2018 (KR) ..... 10-2018-0069674
Jun. 18, 2018 (KR) ..... 10-2018-0069675

(51) Int. Cl.
*F04C 27/00* (2006.01)
*F04C 18/02* (2006.01)
(Continued)

(52) U.S. Cl.
CPC ..... *F04C 27/001* (2013.01); *F04C 18/0215* (2013.01); *F04C 23/008* (2013.01);
(Continued)

(58) Field of Classification Search
CPC ..... F04C 2240/30; F04C 15/0003; F04C 18/0215; F04C 23/008; F04C 27/001;
(Continued)

(56) References Cited

U.S. PATENT DOCUMENTS 4,549,861 A * 10/1985 Blain ..... F01C 1/023 415/89
4,842,499 A * 6/1989 Nishida ..... F04C 18/023 418/188

(Continued)

FOREIGN PATENT DOCUMENTS

CN 103727035 4/2014
CN 105370572 3/2016

(Continued)

OTHER PUBLICATIONS

Extended European Search Report in European Application No. 19180799.9, dated Aug. 30, 2019, 7 pages.

(Continued)

*Primary Examiner* — Nathan C Zollinger
(74) *Attorney, Agent, or Firm* — Fish & Richardson P.C.

(57) ABSTRACT

A compressor is disclosed. The compressor includes a case having an oil reservoir space for storing oil in a lower portion of the case and a refrigerant discharge pipe for discharging a compressed refrigerant in an upper portion of the case, a drive motor provided in the case, a rotary shaft rotatably coupled to the drive motor, a compression unit coupled to the rotary shaft to compress the refrigerant, and a discharge cover hermetically coupled to a lower end of the compression unit and configured to guide an oil-containing refrigerant compressed by the compression unit toward the refrigerant discharge pipe, wherein a guide is provided between the compression unit and the discharge cover and configured to guide an oil-containing refrigerant discharged from the compression unit toward the refrigerant discharge pipe.

11 Claims, 8 Drawing Sheets

(51) Int. Cl.

| | |
|---|---|
| ***F04C 23/00*** | (2006.01) |
| *F04C 29/12* | (2006.01) |
| *F04C 23/02* | (2006.01) |
| *F04C 29/02* | (2006.01) |

(52) U.S. Cl.
CPC ..... *F04C 23/02* (2013.01); *F04C 29/028* (2013.01); *F04C 29/12* (2013.01); *F04C 2210/22* (2013.01)

(58) Field of Classification Search
CPC ..... F04C 27/003; F04C 27/007; F04C 29/12; F04C 29/028
See application file for complete search history.

(56) References Cited

U.S. PATENT DOCUMENTS 5,449,279 A * 9/1995 Hill ..... F04C 18/023 418/55.5
2008/0075614 A1* 3/2008 Fujioka ..... F01C 19/005 418/55.4
2008/0101972 A1* 5/2008 Tarng ..... F04C 29/126 418/55.1
2018/0073505 A1 3/2018 Choi et al.

FOREIGN PATENT DOCUMENTS

| | | | |
|---|---|---|---|
| JP | S61040473 | | 2/1986 |
| JP | 08247062 | A * | 9/1996 |
| JP | H08247062 | | 9/1996 |
| JP | H08312565 | | 11/1996 |
| JP | 2001207976 | | 8/2001 |
| KR | 1020090012841 | | 2/2009 |
| KR | 1020160020190 | | 2/2016 |
| WO | WO2013168194 | | 11/2013 |

OTHER PUBLICATIONS

Chinese Office Action in Chinese Application No. 201910524922.5, dated Oct. 30, 2020, 17 pages (with English translation).

* cited by examiner

COMPRESSOR

CROSS-REFERENCE TO RELATED APPLICATIONS

This application claims the benefit of Korean Patent Application Nos. 10-2018-0069674 and 10-2018-0069675, filed on Jun. 18, 2018, which is hereby incorporated by reference as if fully set forth herein.

TECHNICAL FIELD

The present invention relates to a compressor, and more particularly, to a compressor capable of preventing oil circulating in the compressor from accumulating at a specific position on a refrigerant passage.

BACKGROUND

Generally, a compressor is applied to a refrigerant compression type refrigeration cycle (hereinafter referred to simply as a refrigeration cycle) such as a refrigerator or an air conditioner.

Compressors may be classified into reciprocating compressors and rotary compressors according to how the refrigerant is compressed. The rotary compressors may include a scroll compressor.

Scroll compressors may be divided into an upper compression type or a lower compression type according to the positions of a drive motor and a compression unit. In the upper compression type compressor, the compression unit is located over the drive unit. In the lower compression type compressor, the compression unit is located under the drive motor.

Here, in the case of the lower compression type scroll compressor, oil may be relatively uniformly supplied because the distance between an oil reservoir space and the compression unit is short.

In the conventional lower compression type scroll compressor, residual oil may be formed at a specific position on the oil flow path.

Such residual oil hinders smooth circulation of the oil. Thus, residual oil may damage the compressor or lower the efficiency of the compressor.

Further, residual oil may reduce a space for flow of the refrigerant, thereby lowering the efficiency of the compressor.

Such residual oil may be particularly accumulated in a discharge cover, which is disposed at the lower end of the compression unit to guide an oil-containing refrigerant toward a refrigerant discharge port.

When a part of the refrigerant compressed by the compressor leaks before reaching a refrigerant discharge pipe, the efficiency of the compressor may be lowered.

For example, a part of the refrigerant compressed in the compression unit may leak through a gap between the discharge cover coupled to the lower end of the compression unit and the lower end of the compression unit.

Particularly, in the conventional lower compression type scroll compressor, the discharge cover is coupled to the lower end of the compression unit. Accordingly, if there is a tiny gap between the lower end of the compression unit and the coupling portion of the discharge cover, a part of the refrigerant may leak through the gap.

That is, in the conventional compressor, the overall efficiency of the compressor may be lowered due to the leakage of the refrigerant.

SUMMARY

Accordingly, the present invention is directed to a compressor that substantially obviates one or more problems due to limitations and disadvantages of the related art.

An object of the present invention is to provide a compressor capable of preventing oil circulating in the compressor from remaining in place in order to prevent damage to the compressor.

Another object of the present invention is to provide a compressor capable of securing a sufficient space for flow of a refrigerant by preventing residual oil from remaining on a refrigerant passage in the compressor.

Another object of the present invention is to provide a compressor capable of persistently maintaining optimum compression efficiency by preventing the residual oil from remaining in place.

Another object of the present invention is to provide a compressor capable of preventing leakage of a compressed refrigerant.

Another object of the present invention is to provide a compressor capable of preventing leakage of a compressed refrigerant to preventing degradation of efficiency of the compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a compressor includes a case having an oil reservoir space for storing oil in a lower portion of the case and a refrigerant discharge pipe for discharging a compressed refrigerant in an upper portion of the case, a drive motor provided in the case, a rotary shaft rotatably coupled to the drive motor, a compression unit coupled to the rotary shaft to compress the refrigerant, and a discharge cover hermetically coupled to a lower end of the compression unit and configured to guide an oil-containing refrigerant compressed by the compression unit toward the refrigerant discharge pipe.

A guide may be provided between the compression unit and the discharge cover and configured to guide an oil-containing refrigerant discharged from the compression unit toward the refrigerant discharge pipe. The guide may prevent residual oil from remaining on the bottom of the discharge cover.

The compression unit may include a first discharge hole formed to discharge the compressed oil-containing refrigerant to the discharge cover, and a second discharge hole outwardly spaced from the first discharge hole in a radial direction of the compression unit and formed to guide the oil-containing refrigerant toward the refrigerant discharge pipe.

Herein, the guide may be formed to guide the oil-containing refrigerant discharged through the first discharge hole to the second discharge hole. Since the oil-containing refrigerant can be guided to the second discharge hole via the bottom of the discharge cover by the guide, residual oil may be prevented from remaining on the bottom of the discharge cover.

According to a first embodiment of the guide, the guide may include a blocking wall extending in a vertical direction. The blocking wall may be inwardly spaced from a sidewall of the discharge cover in a radial direction of the discharge cover, wherein a lower end of the blocking wall may be spaced upward from the bottom of the discharge cover.

The blocking wall may be disposed between the first discharge hole and the second discharge hole with respect to the radial direction of the discharge cover. The sidewall of the discharge cover and the blocking wall may define an inflow passage therebetween, the inflow passage communicating with the second discharge hole.

The guide may include a fixing member provided to fix an upper end of the blocking wall to the compression unit. The fixing member may be integrated with the blocking wall.

According to a second embodiment, the guide may be disposed adjacent to the sidewall of the discharge cover and be formed in a tubular shape. A first longitudinal end portion of the guide may be in contact with a bottom surface of the discharge cover and a second longitudinal end portion thereof may communicate with the second discharge hole.

The guide may be formed to be curved at a preset curvature. For example, the guide may be curved such that the first end portion is disposed radially inside of the discharge cover as compared with the second end portion.

The first end portion may be disposed between the first discharge hole and the second discharge hole with respect to a radial direction of the discharge cover.

According to this embodiment, flow resistance of the refrigerant may minimized and residual oil may be prevented from remaining on the bottom of the discharge cover.

According to a third embodiment, the guide may include a stepped portion provided on the bottom of the discharge cover and stepped downward, and a sidewall passage provided in a sidewall of the discharge cover so as to correspond to the stepped portion, the sidewall passage communicating with the second discharge hole.

The stepped portion may be disposed on a radially outer side of the bottom of the discharge cover, wherein the sidewall passage may include a horizontal passage provided to correspond to the stepped portion, and a vertical passage extending from the horizontal passage toward the second discharge hole.

According to a fourth embodiment, the guide may include an inclined surface formed on the bottom of the discharge cover and inclined down toward a radially outer side of the discharge cover, and a sidewall passage provided in a sidewall of the discharge cover so as to correspond to a radially outer side of the inclined surface, the sidewall passage communicating with the second discharge hole.

Herein, the upper end of the inclined surface may be provided to correspond to a radial center of a bottom of the discharge cover or to face the first discharge hole.

According to the third and fourth embodiments, residual oil which may remain on the bottom of the discharge cover may be more efficiently guided toward the second discharge hole.

The compressor according to the present invention may be formed as a scroll compressor. That is, the above-described compression unit may include a main frame provided under the drive motor, a fixed scroll provided under the main frame, and an orbiting scroll provided between the main frame and the fixed scroll and engaged with the fixed scroll to perform an orbiting motion to form a compression chamber in cooperation with the fixed scroll.

Herein, the first discharge hole may be formed through the fixed scroll in a penetrating manner, and the second discharge hole may be formed through the fixed scroll and the main frame in a penetrating manner.

In another aspect of the present invention, a compressor includes a case having a refrigerant discharge pipe for discharging a compressed refrigerant in an upper portion thereof, a drive motor provided in the case, a rotary shaft rotatably coupled to the drive motor, a compression unit formed to compress the refrigerant and provided with a shaft support portion protruding downward such that at least a part of the rotary shaft is provided therethrough; an oil feeder coupled to the rotary shaft and extending in a longitudinal direction of the rotary shaft toward the oil reservoir space, and a discharge cover provided with a through hole through which the oil feeder is provided, the discharge cover guiding the refrigerant compressed by the compression unit toward the refrigerant discharge pipe.

Herein, a sealing member may be provided between coupling portions of the compression unit and the discharge cover. Leakage of the refrigerant through the coupling portions of the compression unit and the discharge cover may be prevented by the sealing member.

The discharge cover may include an inner sidewall coupled to the shaft support portion. The sealing member may include a first sealing member disposed between the inner sidewall and the shaft support portion.

The first sealing member may prevent the refrigerant from leaking through a gap between the inner sidewall of the discharge cover and the shaft support portion.

A radially inner or outer periphery of the shaft support portion may be provided with a fastening groove on a bottom surface of the compression unit such that an upper end portion of the inner sidewall is fastened to the fastening groove. As the upper end portion of the inner sidewall is fastened to the fastening groove, leakage of the refrigerant may be more reliably prevented.

The shaft support portion and at least a part of the inner sidewall may be disposed to overlap each other in a radial direction. Herein, the shaft support portion may be provided with a first sealing groove and the inner sidewall may be provided with a second sealing groove, the first sealing groove and the second sealing groove being formed at positions corresponding to each other for arrangement of the first sealing member.

The discharge cover may further include an outer sidewall formed to define a radially outer periphery thereof, the outer sidewall being coupled to a stepped portion provided at a radially outer side of the lower end of the compression unit. The sealing member may include a second sealing member disposed between the outer sidewall and the stepped portion.

The second sealing member may prevent the refrigerant from leaking through a gap between the outer sidewall of the discharge cover and the stepped portion of the compression unit.

The outer sidewall may include a vertical portion corresponding to a side surface of the stepped portion and a horizontal portion corresponding to a top surface of the stepped portion, the horizontal portion horizontally extending from an upper end of the vertical portion.

Herein, the second sealing member may be disposed between the top surface of the stepped portion and the horizontal portion. Specifically, the top surface of the stepped portion may be provided with a third sealing groove and the horizontal portion may be provided with a fourth sealing groove, the third sealing groove and the fourth sealing groove being formed at positions corresponding to each other for arrangement of the second sealing member.

Alternatively, the second sealing member may be disposed between the side surface of the stepped portion and the vertical portion. Specifically, the side surface of the stepped portion may be provided with a fifth sealing groove and the vertical portion may be provided with a sixth sealing groove, the fifth sealing groove and the sixth sealing groove being formed at positions corresponding to each other for arrangement of the second sealing member.

The top surface of the stepped portion and the horizontal portion may be disposed so as to at least partially overlap each other in a height direction of the discharge cover. In addition, the side surface of the stepped portion and the vertical portion may be disposed so as to at least partially overlap each other in a height direction of the discharge cover. Accordingly, as the contact area between the compression unit and the discharge cover increases, leakage of the refrigerant may be more reliably prevented.

The first sealing member and the second sealing member may be formed as an O-ring or a gasket.

The compressor according to the present invention may be formed as a scroll compressor. That is, the compression unit may include a main frame provided under the drive motor, a fixed scroll provided under the main frame, and an orbiting scroll provided between the main frame and the fixed scroll and engaged with the fixed scroll to perform an orbiting motion to form a compression chamber in cooperation with the fixed scroll.

Herein, the first discharge hole may be formed through the fixed scroll in a penetrating manner, and the second discharge hole may be formed through the fixed scroll and the main frame in a penetrating manner.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, the overall structure of a compressor according to the present invention will be described with reference to FIG. 1.

Figure 1:
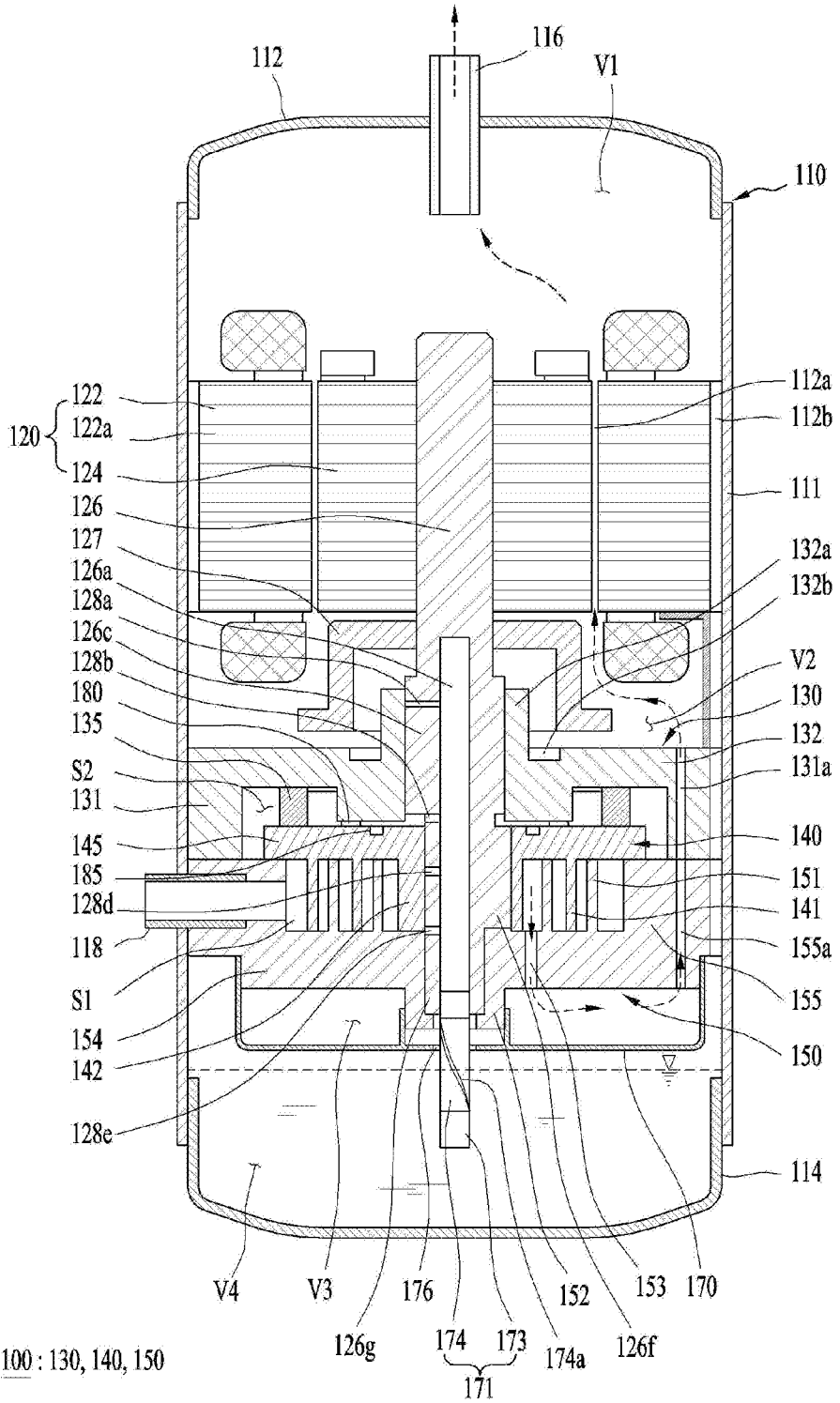
FIG. 1 is a sectional view showing a compressor according to the present invention.

FIG. 1 is a sectional view showing a compressor according to the present invention. The compressor according to the present invention may represent a scroll compressor unless stated otherwise.

The compressor according to the present invention may include a case 110, a drive motor 120, a compression unit 100, and a rotary shaft 126.

The case 110 may be formed to have an inner space. For example, an oil reservoir space in which oil is stored may be provided in a lower portion of the case 110. The oil reservoir space may refer to a fourth space V4 which will be described later. That is, the fourth space V4, which will be described later, may be formed as the oil reservoir space.

In addition, a refrigerant discharge pipe 116 for discharging the compressed refrigerant may be provided on one side of the case 110. For example, the refrigerant discharge pipe 116 may be provided at an upper portion of the case 110.

Specifically, the inner space of the case 110 may include a first space V1 directed from the drive motor 120 to the refrigerant discharge pipe 116, a second space V2 provided between the drive motor 120 and the compression unit 100, a third space V3 partitioned by a discharge cover 170, which will be described later, and a fourth space V4 extending from the compression unit 100 in a direction away from the refrigerant discharge pipe 116.

The case 110 may be formed in a cylindrical shape. For example, the case 110 may include a cylindrical shell 111 having open upper and lower ends.

A first shell 112 may be provided on one side of the cylindrical shell 111 and a second shell 114 may be provided on an opposite side of the cylindrical shell 111. The first and second shells 112 and 114 may be joined to the cylindrical shell 111 by, for example, welding to form an inner space.

The first shell 112 may be provided with the refrigerant discharge pipe 116. The refrigerant compressed by the compression unit 100 may be discharged to the outside through the refrigerant discharge pipe 116. For example, the refrigerant compressed by the compression unit 100 may sequentially pass through the third space V3, the second space V2, and the first space V1, and then be discharged to the outside through the refrigerant discharge pipe 116.

Although not shown in the drawings, an oil separator configured to separate the oil mixed in the refrigerant discharged to the outside may be connected to the refrigerant discharge pipe 116 or disposed at one side of the refrigerant discharge pipe 116.

The second shell 114 may define the fourth space V4, which is the oil reservoir space in which oil can be stored. The fourth space V4 may function as an oil chamber for supplying oil to the compression unit 100 such that the compressor can be smoothly operated.

Further, a refrigerant suction pipe 118, which is a passage through which the refrigerant to be compressed is introduced, may be provided on a side surface of the cylindrical shell 111. The refrigerant suction pipe 118 may be provided along the side surface of a fixed scroll 150, which will be described later, all the way to a compression chamber S1 in a penetrating manner.

The drive motor 120 may be provided inside the case 110. For example, the drive motor 120 may be disposed over the compression unit 100 in the case 110.

The drive motor 120 may include a stator 122 and a rotor 124. The stator 122 may be cylindrical, for example, and may be fixed to the case 110. A coil 122*a* may be wound around the stator 122. In addition, a refrigerant passage groove 112*a* may be formed between the outer circumferential surface of the rotor 124 and the inner circumferential surface of the stator 122 to allow the refrigerant or oil discharged from the compression unit 100 to pass therethrough. That is, the refrigerant passage groove 112*a* may be defined by the inner circumferential surface of the stator 122 and the outer circumferential surface of the rotor 124.

The rotor 124 may be disposed radially inside the stator 122 and generate rotational power. That is, a rotary shaft 126 may be press-fitted into the center of the rotor 124 and thus the rotor 124 may rotate together with the rotary shaft 126. The rotational power generated by the rotor 124 may be transmitted to the compression unit 100 via the rotary shaft 126.

The compression unit 100 may be coupled to the drive motor 120 to compress the refrigerant.

The compression unit 110 may include a main frame 130, a fixed scroll 150, and an orbiting scroll 140.

The compression unit 100 may further include an Oldham's ring 135. The Oldham's ring 135 may be disposed between the orbiting scroll 140 and the main frame 130. The Oldham's ring 135 enables the orbiting movement of the orbiting scroll 140 on the fixed scroll 150 while preventing rotation of the orbiting scroll 140.

The main frame 130 may be provided on one side of the drive motor 120 to form a part of the compression unit 100.

For example, the main frame 130 may be provided under the drive motor 120 to form an upper portion of the compression unit 100.

The main frame 130 may include a frame head plate portion 132 (hereinafter referred to as a first head plate portion) having an approximately circular shape, a frame shaft support portion 132*a* (hereinafter referred to as a "first shaft support portion") provided at the center of the first head plate portion 132 and penetrated by the rotary shaft 126, and a frame sidewall portion 131 (hereinafter referred to as a "first sidewall portion") protruding from an outer circumferential portion of the first head plate portion 132.

The outer circumferential portion of the first sidewall portion 131 may contact the inner circumferential surface of the cylindrical shell 111 and one end portion of the first sidewall portion 131 may contact one end portion of a fixed scroll sidewall portion 155, which will be described later. For example, a lower end of the first sidewall portion 131 may contact an upper end of the fixed scroll sidewall portion 155.

The first sidewall portion 131 may be provided with a frame discharge hole 131*a* axially penetrating the first sidewall portion 131 to form a refrigerant passage. The frame discharge hole 131*a* may have an inlet communicating with an outlet of a fixed scroll discharge hole 155*a*, which will be described later, and an outlet communicating with the second space V2. The frame discharge hole 131*a* and the fixed scroll discharge hole 155*a* communicating with each other may be represented as a second discharge hole 131*a*, 155*a*.

A plurality of frame discharge holes 131*a* may be provided along the periphery of the main frame 130. In addition, a plurality of fixed scroll discharge holes 155*a* may be provided along the periphery of the fixed scroll 150 to correspond to the frame discharge holes 131*a*.

The first shaft support portion 132*a* may protrude from a top surface of the first head plate portion 132 toward the drive motor 120. Further, the first shaft support portion 132*a* may be provided with a first bearing portion such that a main bearing portion 126*c* of the rotary shaft 126, which will be described later, is supported by the first bearing portion in a penetrating manner.

That is, the first shaft support portion 132*a*, through which the main bearing portion 126*c* of the rotary shaft 126 constituting the first bearing portion is rotatably inserted so as to be supported, may be axially formed through the center of the main frame 130 in a penetrated manner.

An oil pocket 132*b* for collecting oil discharged from a gap between the first shaft support portion 132*a* and the rotary shaft 126 may be formed in the top surface of the first head plate portion 132.

The oil pocket 132*b* may be concavely formed in one surface of the first head plate portion 132 and may be formed in an annular shape along the circumference of the first shaft support portion 132*a*. For example, the oil pocket 132*b* may be concavely formed in the top surface of the first head plate portion 132.

In addition, a space may be formed on the bottom surface of the main frame 130 together with the fixed scroll 150 and the orbiting scroll 140. Thereby, a back pressure chamber S2 may be formed to support the orbiting scroll 140 by the pressure of the space.

For reference, the back pressure chamber S2 may include an intermediate pressure region (i.e., an intermediate pressure chamber), and the oil supply passage 126*a* provided in the rotary shaft 126 may include a high pressure region having a higher pressure than the back pressure chamber S2.

A back pressure seal 180 may be provided between the main frame 130 and the orbiting scroll 140 to distinguish the high pressure region from the intermediate pressure region. The back pressure seal 180 may serve as, for example, a sealing member.

In addition, the main frame 130 may be coupled with the fixed scroll 150 to form a space in which the orbiting scroll 140 can be provided so as to make an orbiting movement.

The fixed scroll 150 may be provided on one side of the main frame 130. That is, the fixed scroll 150, which is the first scroll, may be coupled to the one surface of the main frame 130.

For example, the fixed scroll 150 may be provided under the main frame 130.

The fixed scroll 150 may include a fixed scroll head plate portion 154 (hereinafter referred to as a second head plate portion) having an approximately circular shape, a fixed scroll sidewall portion 155 (hereinafter referred to as a "second sidewall portion") protruding from an outer circumferential portion of the second head plate portion 154, a fixed lap 151 protruding from one surface of the second head plate portion 154 and engaging with an orbiting lap 141 of the orbiting scroll 140, which will be described later, to form a compression chamber S1, and a fixed scroll shaft support portion 152 (hereinafter referred to as a "second shaft support portion") formed at the center of the rear surface of the second head plate portion 154, the rotary shaft 126 being provided through the second shaft support portion 152.

The compression unit 100 may include a first discharge hole 153 for discharging the compressed refrigerant to the discharge cover 170 and a second discharge hole 131*a*, 155*a* outwardly spaced from the first discharge hole 153 in the radial direction of the compression unit 100 to guide the compressed refrigerant toward the refrigerant discharge pipe 116.

Specifically, the first discharge hole 153 for guiding the compressed refrigerant from the compression chamber S1 to the inner space of the discharge cover 170 may be formed in the second head plate 154. The position of the first discharge hole 153 may be arbitrarily set in consideration of the required discharge pressure and the like.

As the first discharge hole 153 is provided to face the second shell 114, a discharge cover 170 for guiding the refrigerant discharged from the compression unit to a fixed scroll discharge hole 155*a*, which will be described later, may be coupled to the bottom surface of the fixed scroll 150.

The discharge cover 170 may be coupled to one end of the compression unit 100. The discharge cover 170 may be formed to guide the refrigerant compressed by the compression unit 100 toward the refrigerant discharge pipe 116.

For example, the discharge cover 170 may be hermetically coupled to the bottom surface of the fixed scroll 150 to separate the refrigerant discharge passage from the fourth space V4.

The discharge cover 170 may be coupled to a sub-bearing portion 126*g* of the rotary shaft 126, which constitutes the second bearing portion. Thereby, a through hole 176 may be formed such that an oil feeder 171 at least partly immersed in the oil contained in the fourth space V4 of the case 110 is provided through the through hole 176.

The second sidewall portion 155 may be provided with a fixed scroll discharge hole 155*a*, which is axially formed through the second sidewall portion 155 in a penetrating manner and defines a refrigerant passage together with the frame discharge hole 131*a*.

The fixed scroll discharge hole 155*a* may be formed to correspond to the frame discharge hole 131*a*. The inlet of the fixed scroll discharge hole 155*a* may communicate with the inner space of the discharge cover 170, and the outlet of the fixed scroll discharge hole 155*a* may communicate with the inlet of the frame discharge hole 131*a*.

The fixed scroll discharge hole 155*a* and the frame discharge hole 131*a* may allow the second space V2 and the third space V3 to communicate with each other such that the refrigerant discharged from the compression chamber S1 into the inner space of the discharge cover 170 is guided to the second space V2.

The second sidewall portion 155 may be provided with a refrigerant suction pipe 118 communicating with the suction side of the compression chamber S1. In addition, the refrigerant suction pipe 118 may be provided spaced apart from the fixed scroll discharge hole 155*a*.

The second shaft support portion 152 may protrude from the bottom surface of the second head plate portion 154 toward the fourth space V4. The second shaft support portion 152 may be provided with a second bearing portion such that the sub-bearing portion 126*g* of the rotary shaft 126 is inserted into and supported by the second bearing portion.

One end portion of the second shaft support portion 152 may be bent toward the shaft center to support the lower end of the sub-bearing portion 126*g* of the rotary shaft 126 and form a thrust bearing surface.

The orbiting scroll 140 may be disposed between the main frame 130 and the fixed scroll 150 to form a second scroll.

Specifically, the orbiting scroll 140 may be coupled to the rotary shaft 126 to form a pair of two compression chambers S1 between the orbiting scroll 140 and the fixed scroll 150 while performing the orbiting motion.

The orbiting scroll 140 may include an orbiting scroll plate portion 145 (hereinafter referred to as a "third head plate portion") having an approximately circular shape, an orbiting lap 141 protruding from the bottom surface of the third head plate portion 145 and engaging with the fixed lap 151, and a rotary shaft coupling portion 142 provided at the center of the third head plate portion 145 and rotatably coupled to an eccentric portion 126*f* of the rotary shaft 126.

The outer circumferential portion of the third head plate portion 145 may be disposed at one end of the second sidewall portion 155 and one end of the orbiting lap 141 may be brought into close contact with one surface of the second head plate portion 154 and supported by the fixed scroll 150.

For reference, the top surface of the orbiting scroll 140 may be provided with a pocket groove 185 for guiding the oil discharged through oil holes 128*a*, 128*b*, 128*d*, and 128*e*, which will be described later, to the intermediate pressure chamber.

Specifically, the pocket groove 185 may be concavely formed in the top surface of the third head plate portion 145. That is, the pocket groove 185 may be formed in one surface of the third head plate portion 145 between the back pressure seal 180 and the rotary shaft 126.

As shown in the figure, one or more pocket grooves 185 may be formed on both sides of the rotary shaft 126. The pocket grooves 185 may be annularly formed on one surface of the third head plate portion 145 around the rotary shaft 126 between the back pressure seal 180 and the rotary shaft 126.

The outer circumferential portion of the rotary shaft coupling portion 142 is connected to the orbiting lap 141 to form the compression chamber S1 in cooperation with the fixed lap 151 in the compression process.

The fixed lap 151 and the orbiting lap 141 may be formed in an involute shape. Here, the involute shape may refer to a curve corresponding to a locus drawn by an end of a thread when the thread wound around a base circle having an arbitrary radius is released.

The eccentric portion 126*f* of the rotary shaft 126 may be inserted into the rotary shaft coupling portion 142. The eccentric portion 126*f* inserted into the rotary shaft coupling portion 142 may overlap the orbiting lap 141 or the fixed lap 151 in the radial direction of the compressor.

Here, the radial direction may refer to a direction (i.e., the horizontal direction) perpendicular to the axial direction (i.e., the vertical direction).

As described above, when the eccentric portion 126*f* of the rotary shaft 126 is provided through the third head plate portion 145 so as to radially overlap the orbiting lap 141, the repulsive force and the compressive force of the refrigerant may be canceled to a certain degree as they are applied to the same plane with respect to the third head plate portion 145.

The rotary shaft 126 may be coupled to the drive motor 120 and may include an oil supply passage 126*a* for guiding the oil contained in the fourth space V4, which is an oil reservoir space of the case 110, to the compression unit.

Specifically, one side of the rotary shaft 126 may be press-fitted and coupled to the center of the rotor 124, and the opposite side thereof may be coupled to the compression unit 100 and supported in a radial direction.

The rotary shaft 126 may transmit the rotational power of the drive motor 120 to the orbiting scroll 140 of the compression unit 100. Thereby, the orbiting scroll 140 eccentrically coupled to the rotary shaft 126 may perform an orbiting motion with respect to the fixed scroll 150.

The rotary shaft 126 may be provided with a main bearing portion 126*c* inserted into the first shaft support portion 132*a* of the main frame 130 and radially supported. The main bearing portion 126*c* may be provided with the sub-bearing portion 126*g* inserted into the second shaft support portion 152 of the fixed scroll 150 and radially supported. The eccentric portion 126*f* may be formed between the main bearing portion 126*c* and the sub-bearing portion 126*g* so as to be inserted into the rotary shaft coupling portion 142 of the orbiting scroll 140 and coupled therewith.

The main bearing portion 126*c* and the sub-bearing portion 126*g* may be coaxially provided so as to have the same axial center, and the eccentric portion 126*f* may be provided to be radially eccentric with respect to the main bearing portion 126*c* or the sub-bearing portion 126*g*.

The eccentric portion 126*f* may have an outer diameter smaller than the outer diameter of the main bearing portion 126*c* and larger than the outer diameter of the sub-bearing portion 126*g*. This configuration may be advantageous in coupling the rotary shaft 126 to the shaft support portions 132*a* and 152 and the rotary shaft coupling portion 142 in a penetrating manner.

An oil supply passage 126*a* may be formed inside the rotary shaft 126 to supply the oil from the fourth space V4, which is the oil reservoir space, to the outer circumferential surface of the bearing portions 126*c* and 126*g* and the outer circumferential surface of the eccentric portion 126*f*. Further, oil holes 128*a*, 128*b*, 128*d*, and 128*e* may be formed in the bearing portions 126*c* and 126*g* and the eccentric portions 126*f* of the rotary shaft 126 so as to radially extend from the oil supply passage 126*a* to the outer side of the rotary shaft 126.

Specifically, the oil holes may include a first oil hole 128*a*, a second oil hole 128*b*, a third oil hole 128*d*, and a fourth oil hole 128*e*.

The first oil hole 128*a* may be formed through the outer circumferential surface of the main bearing portion 126*c*. The first oil hole 128*a* may be formed to extend from the oil supply passage 126*a* to the outer circumferential surface of the main bearing portion 126*c* in a penetrating manner.

The first oil hole 128*a* may be formed through an upper portion of the outer circumferential surface of the main bearing part 126*c*, but embodiments are not limited thereto. When the first oil hole 128*a* includes a plurality of holes, the respective holes may be formed only in the upper or lower portion of the outer circumferential surface of the main bearing portion 126*c*, or may be formed in the upper and lower portions of the outer circumferential surface of the main bearing portion 126*c*, respectively.

The second oil hole 128*b* may be formed between the main bearing portion 126*c* and the eccentric portion 126*f*. The second oil hole 128*b* may include a plurality of holes, unlike the one shown in the figure.

The third oil hole 128*d* may be formed through the outer circumferential surface of the eccentric portion 126*f*. Specifically, the third oil hole 128*d* may be formed to extend from the oil supply passage 126*a* to the outer circumferential surface of the eccentric portion 126*f* in a penetrating manner.

The fourth oil hole 128*e* may be formed between the eccentric portion 126*f* and the sub-bearing portion 126*g*.

The oil guided through the oil supply passage 126*a* may be discharged through the first oil hole 128*a* and be entirely supplied to the entire outer circumferential surface of the main bearing portion 126*c*.

The oil guided through the oil supply passage 126*a* may be discharged through the second oil hole 128*b*, supplied to one surface of the orbiting scroll 140, and then discharged through the third oil hole 128*d*, thereby being supplied to the entire outer circumferential surface of the eccentric portion 126*f*.

In addition, the oil guided through the oil supply passage 126*a* may be discharged through the fourth oil hole 128*e* and supplied to the outer circumferential surface of the sub-bearing portion 126*g* or a space between the orbiting scroll 140 and the fixed scroll 150.

An oil feeder 171 configured to pump oil contained in the fourth space V4 may be coupled to one end of the rotary shaft 126, that is, one end of the sub-bearing portion 126*g*. The oil feeder 171 may be configured to supply the oil contained in the fourth space V4 toward the oil holes 128*a*, 128*b*, 128*d*, and 128*e*.

The oil feeder 171 includes an oil supply pipe 173 inserted into the oil supply passage 126*a* of the rotary shaft 126 and an oil suction member 174 inserted into the oil supply pipe 173 to suction the oil.

The oil supply pipe 173 may be provided through the through hole 176 of the discharge cover 170 so as to be submerged in the fourth space V4 and the oil suction member 174 may function like a propeller.

The oil suction member 174 may have a helical groove 174*a* extending in the longitudinal direction of the oil suction member 174. The helical groove 174*a* may be formed around the oil suction member 174 and may extend toward the oil holes 128*a*, 128*b*, 128*d*, and 128*e* described above.

The oil accommodated in the fourth space V4 may be guided to the oil holes 128*a*, 128*b*, 128*d* and 128*e* along the helical groove 174*a* when the oil feeder 171 is rotated together with the rotary shaft 126.

The rotor 124 or the rotary shaft 126 may be coupled with a balance weight 127 for suppressing noise and vibration. The balance weight 127 may be provided in the second space V2 between the drive motor 120 and the compression unit 100.

Hereinafter, operation of the scroll compressor according to the embodiment of the present invention will be described.

When power is applied to the drive motor 120 to generate rotational power, the rotary shaft 126 coupled to the rotor 124 of the drive motor 120 begins to rotate. Then, the orbiting scroll 140 eccentrically coupled to the rotary shaft 126 performs an orbiting motion with respect to the fixed scroll 150, forming the compression chamber S1 between the orbiting lap 141 and the fixed lap 151. The compression chamber S1 may be formed to have several steps in succession as the volume thereof gradually decreases toward the center.

The refrigerant supplied from the outside of the case 110 through the refrigerant suction pipe 118 may be directly introduced into the compression chamber S1. The refrigerant may be compressed as it is moves toward the discharge chamber of the compression chamber S1 by the orbiting motion of the orbiting scroll 140. Then, the refrigerant may be discharged from the discharge chamber to the third space V3 through the discharge hole 153 of the fixed scroll 150.

Thereafter, the compressed refrigerant discharged into the third space V3 may be discharged into the inner space of the case 110 through the fixed scroll discharge hole 155*a* and the frame discharge hole 131*a*, and the refrigerant discharged from the refrigerant discharge tube 116, and then discharged from the case 110 through the refrigerant discharge pipe 116. Such operations are repeated.

During the operation of the compressor, the oil contained in the fourth space V4 may be guided upward through the rotary shaft 126 and smoothly supplied to the bearing portions, i.e., bearing surfaces through the plurality of oil holes 128*a*, 128*b*, 128*d*, and 128*e*. Thereby, wear of the bearing portions may be prevented.

The oil discharged through the plurality of oil holes 128*a*, 128*b*, 128*d*, and 128*e* may form an oil film between the fixed scroll 150 and the orbiting scroll 140 to maintain a hermetic state of the compressed unit.

Due to such oil, the refrigerant compressed by the compression unit 100 and discharged to the first discharge hole 153 may have oil mixed therein. Hereinafter, for simplicity, the refrigerant in which oil is mixed will be referred to as oil-containing refrigerant.

The oil-containing refrigerant is guided to the first space V1 via the second discharge hole 131*a*, 155*a*, the second space V2, and the refrigerant passage groove 112*a*. The refrigerant in the oil-containing refrigerant guided to the first space V1 may be discharged from the compressor through the refrigerant discharge pipe 116, and the oil in the oil-containing refrigerant may be discharged into the fourth space V4 through an oil return passage 112*b*.

For example, the oil return passage 112*b* may be disposed at the radially outermost position in the case 110. Specifically, the oil return passage 112*b* may include a passage between the outer circumferential surface of the stator 122 and the inner circumferential surface of the cylindrical shell 111, a passage between the outer circumferential surface of the main frame 130 and the inner circumferential surface of the cylindrical shell 111, and a passage between the outer circumferential surface of the fixed scroll 150 and the inner circumferential surface of the cylindrical shell 111.

When the oil-containing refrigerant is discharged into the third space V3 through the first discharge hole 153, a part of the oil contained in the oil-containing refrigerant may remain in the third space V3 in the process of the oil-containing refrigerant colliding with the discharge cover 170. For example, there may be residual oil remaining on the bottom of the discharge cover 170.

When there is residual oil in the third space V3, the volume of the third space V3 may be reduced. Further, the volumetric reduction of the third space V3 may increase the pressure fluctuation, thereby lowering the efficiency of the compressor.

A guide may be provided between the compression unit 100 and the discharge cover 170 to guide, to the outside of the third space V3, the residual oil on the bottom of the third space V3 and the oil-containing refrigerant discharged through the first discharge hole 153.

For example, the residual oil remaining in the third space V3 (in particular, the bottom of the discharge cover 170) may be guided to the second discharge hole 131*a*, 155*a* using the flow of the oil-containing refrigerant discharge into the third space V3 through the first discharge hole 153. Since the discharge cover 170 is coupled to the compression unit 100, there may be a fine gap between the compression unit 100 and the discharge cover 170. The fine gap may cause refrigerant leakage.

That is, when the refrigerant is discharged into the third space V3 through the first discharge hole 153 of the compression unit 100 and guided to the second discharge hole 131*a*, 155*a*, a part of the refrigerant may leak through a gap which may be present between the compression unit 100 and the discharge cover 170.

Further, such leakage of the refrigerant may lower the compression efficiency of the compressor. Such an issue may be addressed by sealing members 210 and 220 provided between the compression unit 100 and the discharge cover 170 (that is, between the coupling portions of the compression unit 180 and the discharge cover 170) and the structure of coupling between the compression unit 100 and the discharge cover 170.

Hereinafter, various embodiments of the guide capable of preventing residual oil from remaining inside the discharge cover 170 will be described with reference to another drawing. In FIGS. 2 to 5, the oil feeder 171 described above is omitted in order to facilitate understanding of the refrigerant flow.

Figure 2:
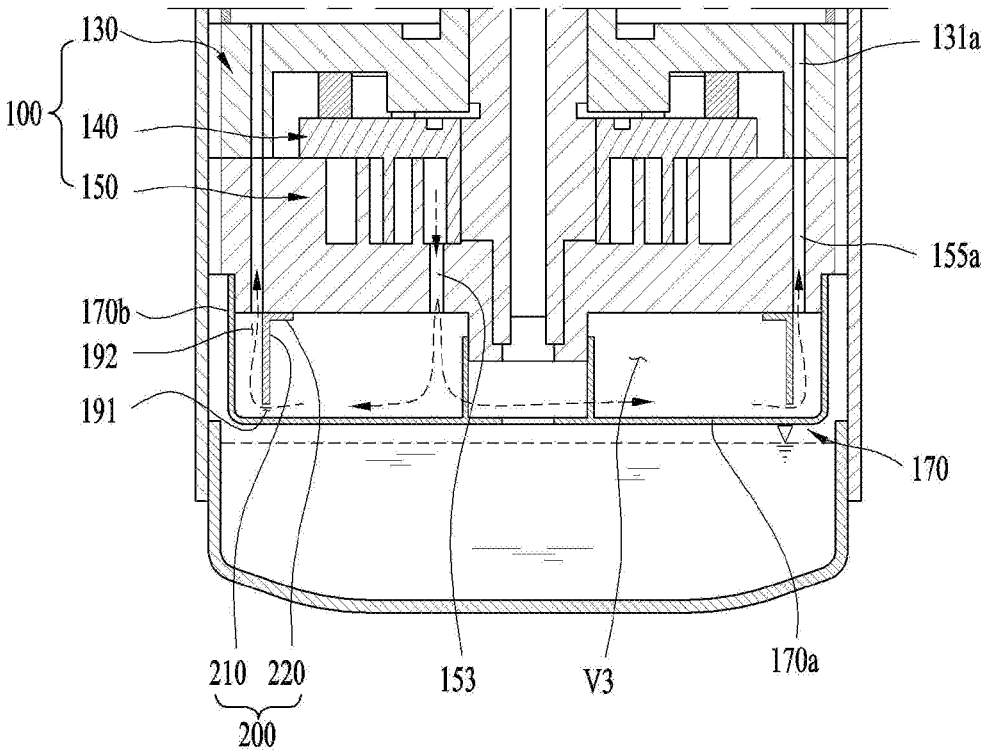
FIG. 2 is a view showing a first embodiment of a guide provided in the compressor of FIG. 1 in order to prevent residual oil from remaining in place.

FIG. 2 is a view showing a first embodiment of a guide that may be provided in the compressor of FIG. 1 in order to prevent residual oil from remaining in place. Hereinafter, it is assumed that a plurality of second discharge holes 131*a*, 155*a* is provided along the periphery of the compression unit. Accordingly, in the sectional views of FIGS. 2 to 5, two second discharge holes 131*a*, 155*a* facing each other may be shown.

Referring to FIG. 2, a guide 200 may be provided between the compression unit 100 and the discharge cover 170. The guide 200 may be formed to guide the oil-containing refrigerant discharged from the compression unit 100 toward the refrigerant discharge pipe 116.

The guide 200 may be formed to guide the oil-containing refrigerant discharged through the first discharge hole 153 to the second discharge hole 131*a*, 155*a*.

The oil-containing refrigerant discharged through the first discharge hole 153 may be guided by the guide 200 to the second discharge hole 131*a*, 155*a* via a discharge surface 170*a* of the discharge cover 170. That is, the oil-containing refrigerant discharged through the first discharge hole 153 may collide with the discharge surface 170*a* of the discharge cover 170 and then be guided to the second discharge hole 131*a*, 155*a* by the guide 200.

Therefore, residual oil that may be on the bottom of the third space V3 (i.e., the discharge surface 170*a* of the discharge cover 170) may be guided to the second discharge hole 131*a*, 155*a* by the flow of the oil-containing refrigerant. That is, residual oil may be prevented from remaining on the discharge surface 170*a* of the discharge cover 170 through the flow of the oil-containing refrigerant generated formed by the guide 200.

In this embodiment, the guide 200 may include a blocking wall 210 extending in a vertical direction. Here, the blocking wall 210 may be radially inwardly spaced from the sidewall 170*b* of the discharging cover 170. The lower end of the blocking wall 210 may be upwardly spaced from the discharge surface 170*a* of the discharge cover 170.

For example, the lower end of the blocking wall 210 may be upwardly spaced from the discharge surface 170*a* of the discharge cover 170 such that a fine gap 191 is formed between the lower end of the blocking wall 210 and the discharge surface 170*a* of the discharging cover 170.

That is, the oil-containing refrigerant discharged through the first discharge hole 153 may flow along the discharge surface 170*a* of the discharge cover 170 and pass through the gap 191 between the lower end of the blocking wall 210 and the discharge surface 170*a* of the discharge cover 170.

Accordingly, residual oil that may be present on the discharge surface 170*a* of the discharge cover 170 may be expelled from the third space V3 by the blocking wall 210. Thereby, residual oil may be prevented from remaining on the discharge surface 170*a* of the discharge cover 170.

The blocking wall 210 may be provided between the first discharge hole 153 and the second discharge hole 131*a*, 155*a* with respect to the radial direction of the discharge cover 170. That is, the blocking wall 210 may be disposed between the first discharge hole 153 and the fixed scroll discharge hole 155*a* with reference to the radial direction of the discharge cover 170.

In order for the oil-containing refrigerant discharged to the first discharge hole 153 to flow into the second discharge hole 131*a*, 155*a*, the oil-containing refrigerant should pass through the gap 191 between the blocking wall 210 and the discharge surface 170*a* of the discharge cover 170. In this process, oil which may remain accumulated on the discharge surface 170*a* of the discharge cover 170 may flow into the second discharge hole 131*a*, 155*a* along with the flow of the oil-containing refrigerant.

In addition, an inflow passage 192 may be formed between the sidewall 170*b* of the discharge cover 170 and the blocking wall 210. That is, the inflow passage 192 may be defined by the sidewall 170*b* of the discharge cover 170 and the blocking wall 210.

The inflow passage 192 may communicate with the second discharge hole 131*a*, 155*a*. That is, the inflow passage 192 may communicate with the fixed scroll discharge hole 155*a*.

Accordingly, the oil-containing refrigerant discharged through the first discharge hole 153 may sequentially pass through the gap 191 between the blocking wall 210 and the discharge surface 170*a* of the discharge cover 170 and the inflow passage 192 and flow into the second discharge hole 131*a*, 155*a*.

When the oil-containing refrigerant collides with the blocking wall 210, part of the oil contained in the oil-containing refrigerant may fall to the discharge surface 170*a* of the discharge cover 170 along the blocking wall 210. Even in this case, the oil that has fallen onto the discharge surface 170*a* of the discharge cover 170 may be guided toward the space V1 through the second discharge hole 131*a*, 155*a* by the flow of the oil-containing refrigerant discharged through the first discharge hole 153.

The guide 200 may further include a fixing member 220 for fixing the upper end of the blocking wall 210 to one end of the compression unit 100.

For example, the fixing member 220 may be fixed to the bottom surface of the fixed scroll 150. The fixing member 220 may be formed to horizontally extend between the first discharge hole 153 and the fixed scroll discharge hole 155*a*.

The blocking wall 210 may be fixedly provided at a predetermined position by the fixing member 220.

Hereinafter, a guide according to the second embodiment will be described with reference to another drawing.

Figure 3:
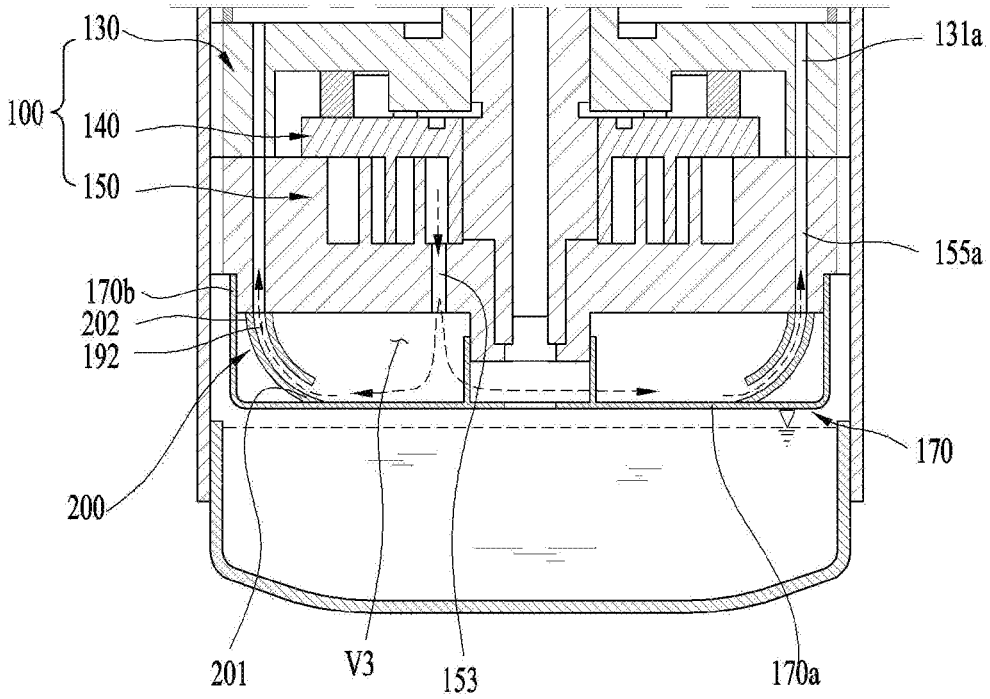
FIG. 3 is a view showing a second embodiment of the guide provided in the compressor of FIG. 1 in order to prevent residual oil from remaining in place.

FIG. 3 is a view showing a second embodiment of the guide that may be provided in the compressor of FIG. 1 in order to prevent residual oil from remaining in place. In this embodiment, the guide 200 may be provided between the compression unit 100 and the discharge cover 170. For example, the guide 200 may be disposed in the third space V3.

Referring to FIG. 3, the guide 200 may be formed in a tubular shape. In addition, the guide 200 may be disposed adjacent to the sidewall 170*b* of the discharge cover 170. For example, the guide 200 may be spaced radially inwardly from the sidewall 170*b* of the discharge cover 170 by a predetermined distance.

A first longitudinal end portion 201 of the guide 200 may be in contact with the discharge surface 170*a* of the discharge cover 170 and a second longitudinal end portion 202 thereof may communicate with the second discharge hole 131*a*, 155*a*.

That is, the periphery of the first longitudinal end portion 201 of the guide 200 may be in contact with the discharge surface 170*a* of the discharge cover 170. The first end portion 201 may face in the extension direction of the discharge surface 170*a*. The second longitudinal end portion 202 of the guide 200 may be hermetically connected to the second discharge hole 131*a*, 155*a*.

Since the guide 200 is formed in a tubular shape, an inflow passage 192 may be formed in the guide 200.

Accordingly, the oil-containing refrigerant discharged through the first discharge hole 153 may flow into the second discharge hole 131*a*, 155*a* through the inflow passage 192 together with residual oil that may be accumulated on the discharge surface 170*a*.

More specifically, in order to minimize flow resistance of the oil-containing refrigerant, the guide 200 may be curved at a preset curvature.

For example, the guide 200 may be curved such that the first end portion 201 of the guide 200 is disposed further inward than the second end portion 202 in the radial direction of the discharge cover 170.

Here, the first end portion 201 may be disposed between the first discharge hole 153 and the second discharge hole 131*a*, 155*a* with respect to the radial direction of the discharge cover 170. That is, the first end portion 201 may be disposed between the first discharge hole 153 and the fixed scroll discharge hole 155*a*.

According to this embodiment, flow resistance of the oil-containing refrigerant may be minimized, and residual oil that may be accumulated on the discharge surface 170*a* of the discharge cover 170 may be expelled from the third space V3.

Hereinafter, a guide according to the third embodiment will be described with reference to another drawing.

Figure 4:
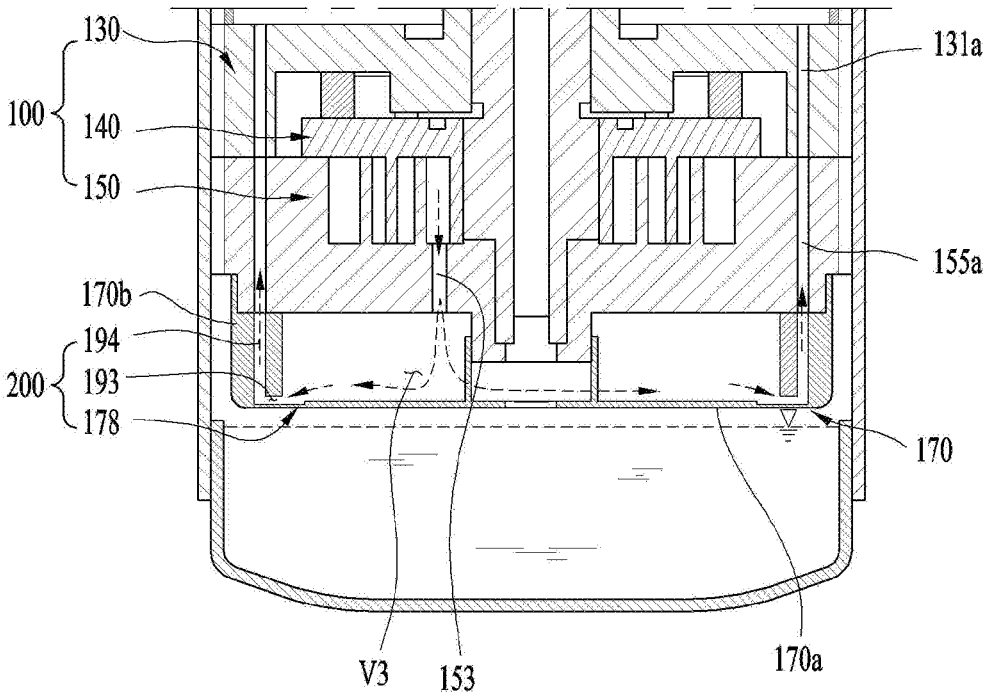
FIG. 4 is a view showing a third embodiment of the guide provided in the compressor of FIG. 1 in order to prevent residual oil from remaining in place.

FIG. 4 is a view showing a third embodiment of the guide that may be provided in the compressor of FIG. 1 in order to prevent residual oil from remaining in place.

According to this embodiment, the guide 200 may include a stepped portion 178 formed on the discharge surface 170*a* of the discharge cover 170 and sidewall passages 193 and 194 provided in the sidewall 170*b* of the discharge cover 170.

The stepped portion 178 may be provided on the discharge surface 170*a* of the discharge cover 170 and formed to step outward. For example, the stepped portion 178 may be formed to be concave upward.

The sidewall passages 193 and 194 may be provided on the sidewall 170*b* of the discharge cover 170 to correspond to the stepped portion 178. That is, the sidewall passages 193 and 194 may be formed through the sidewall 170*b* of the discharge cover 170 in a penetrating manner.

The sidewall passages 193 and 194 may be formed to communicate with the second discharge hole 131*a*, 155*a*.

That is, the sidewall passages 193 and 194 may communicate with the fixed scroll discharge hole 155*a*.

Residual oil that may be accumulated on the discharge surface 170*a* of the discharge cover 170 may be guided to the second discharge hole 131*a*, 155*a* via the stepped portion 178 and the sidewall passages 193 and 194 by the flow of the oil-containing refrigerant.

Specifically, the stepped portion 178 may be disposed at the radially outer side of the discharge surface 170*a* of the discharge cover 170. That is, the stepped portion 178 may be disposed to contact the sidewall 170*b* of the discharge cover 170.

The sidewall passages 193 and 194 include a horizontal passage 193 disposed to correspond to the stepped portion 178 and a vertical passage 193 extending upward from the horizontal passage toward the second discharge hole 131*a*, 155*a*.

The horizontal passage 193 may extend from the inner side surface of the sidewall 170*b* to a middle point of the sidewall 170*b* in the thickness direction. For example, the bottom of the horizontal passage 193 may be disposed at the same height as the bottom of the stepped portion 178. That is, the bottom of the horizontal passage 193 may be on the same level as the bottom of the stepped portion 178.

The vertical passage 194 may extend upward from an end portion of the horizontal passage 193 disposed at the center of the sidewall 170*b* in the thickness direction toward the fixed scroll discharge hole 155*a*.

Accordingly, residual oil that may be accumulated on the discharge surface 170*a* of the discharge cover 170 may be guided along with the oil-containing refrigerant discharged through the first discharge hole 153 to the second discharge hole 131*a*, 155*a* via the stepped portion 178 and the sidewall passages 193 and 194.

Hereinafter, a guide according to the third embodiment will be described with reference to another drawing.

Figure 5:
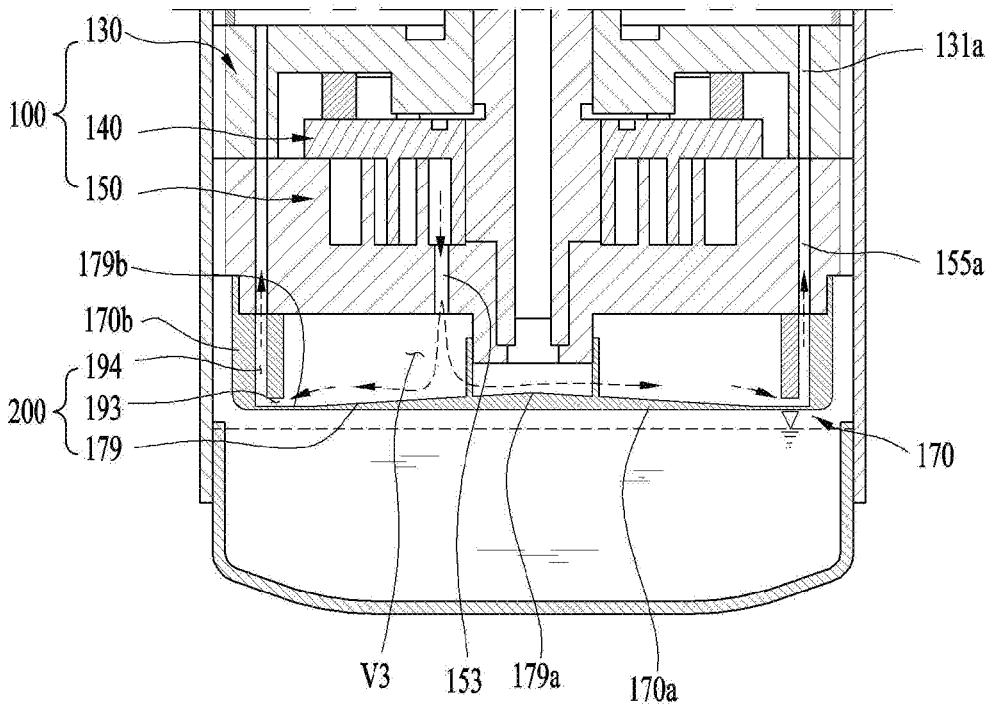
FIG. 5 is a view showing a fourth embodiment of the guide provided in the compressor of FIG. 1 in order to prevent residual oil from remaining in place.

FIG. 5 is a view showing a fourth embodiment of the guide that may be provided in the compressor of FIG. 1 in order to prevent residual oil from remaining in place.

According to this embodiment, the guide 200 may include an inclined surface 179 provided on the discharge surface 170*a* of the discharge cover 170 and sidewall passages 193 and 194 provided in the sidewall 170*b* of the discharge cover 170.

The inclined surface 179 may be provided on the discharge surface 170*a* of the discharge cover 170 and formed to have a thickness gradually decreasing as the inclined surface 179 extends toward the sidewall 170*b*. That is, the inclined surface 179 may be formed to be inclined. For example, the inclined surface 179 may be formed to be inclined downward toward the radially outer side of the discharge cover 170.

The sidewall passages 193 and 194 may be provided in the sidewall 170*b* of the discharge cover 170 to correspond to the radially outer side of the inclined surface 179. That is, the sidewall passages 193 and 194 may be formed through the sidewall 170*b* of the discharge cover 170 in a penetrating manner.

The sidewall passages 193 and 194 may be formed to communicate with the second discharge hole 131*a*, 155*a*. That is, the sidewall passages 193 and 194 may communicate with the fixed scroll discharge hole 155*a*.

Accordingly, residual oil which may be accumulated on the discharge surface 170*a* of the discharge cover 170 may be guided to the second discharge hole 131*a*, 155*a* via the inclined surface 179 and the sidewall passages 193 and 194 by the flow of the oil-containing refrigerant.

Specifically, the inclined surface 179 may be formed on the discharge surface 170*a* of the discharge cover 170 in the third space V3 and inclined downward as it extends toward the sidewall 170*b* of the discharge cover 170.

As shown in FIG. 5, the inside portion 179*a* of the inclined surface 179 may be disposed to correspond to the radial center of the discharge surface 170*a* of the discharge cover 170. Alternatively, the inside portion 179*a* of the inclined surface 179 may be disposed to face the first discharge hole 153.

The outer edge 179*b* of the inclined surface 179 may be disposed to contact the sidewall 170*b* of the discharge cover 170. Residual oil that may be accumulated on the discharge surface 170*a* of the discharge cover 170 may be guided to the sidewall passages 193 and 194 formed in the discharge cover 170 along the inclined surface 179 by the flow of the oil-containing refrigerant.

Herein, the inside portion 179*a* and the outer edge 179*b* of the inclined surface 179 may refer to the highest point and the lowest point of the inclined surface 179.

The sidewall passages 193 and 194 include a horizontal passage 193 disposed to correspond to the outer edge 179*b* of the inclined surface 179 and a vertical passage 194 extending from the horizontal passage 193 toward the second discharge hole 131*a*, 155*a* in the axial direction.

The horizontal passage 193 and the vertical passage 194 may be the same as those described above with reference to FIG. 4. However, in this embodiment, the inclined surface 179 and the horizontal passage 193 may be formed such that the outer edge 179*b* of the inclined surface 179 instead of the stepped portion corresponds to the horizontal passage 193.

Accordingly, residual oil that may be accumulated on the discharge surface 170*a* of the discharge cover 170 may be guided along with the oil-containing refrigerant discharged through the first discharge hole 153 to the second discharge hole 131*a*, 155*a* via the inclined surface face 179 and the sidewall passages 193 and 194.

Figure 6:
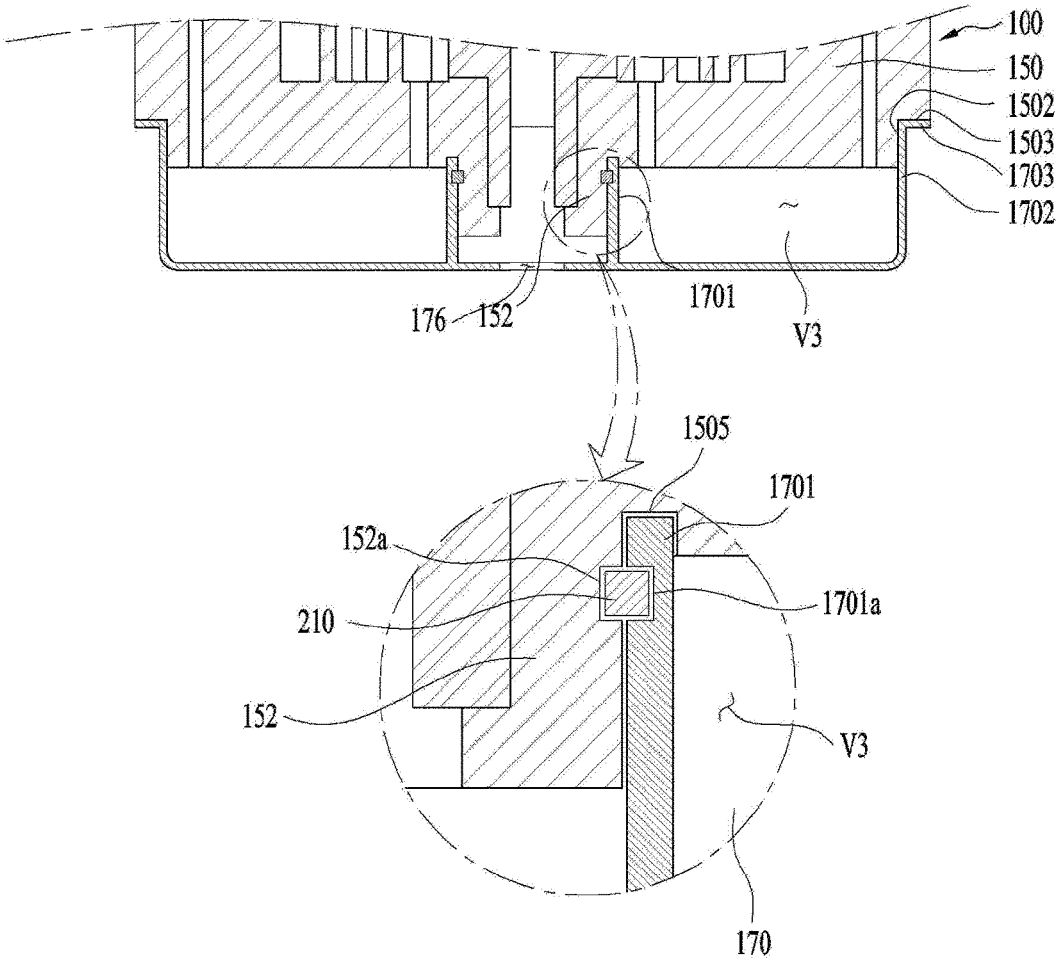
FIG. 6 is a conceptual diagram showing a coupling relationship between the compression unit and the discharge cover coupled to the lower end of the compression unit according to the first embodiment.

FIG. 6 is a conceptual diagram showing a coupling relationship between the compression unit and the discharge cover coupled to the lower end of the compression unit according to the first embodiment.

Referring to FIG. 2, as described above, the compression unit 100 may have a shaft support portion (that is, the second shaft support portion 152), which protrudes downward, at the radial center thereof. In addition, concave stepped surface 1502 and 1503 may be formed on the radially outer side of the lower end of the compression unit 100.

Specifically, the second shaft support portion 152 and the stepped surface 1502 and 1503 may be provided to the fixed scroll 150 described above. That is, the second shaft support portion 152 may be formed to protrude from the radial center portion of the fixed scroll 150, and the step surfaces 1502 and 1503 may be provided at a radially outer side of the fixed scroll 150.

For example, the lower end or bottom surface of the compression unit 100 may correspond to the lower end or bottom surface of the fixed scroll 150.

The discharge surface 170*a* of the discharge cover 170 includes an inner sidewall 1701 coupled to the second shaft support portion 152 and outer sidewall 1702 and 1703 coupled to the stepped surface 1502 and 1503. That is, the inner sidewall 1701 may be disposed at a radially inner side of the discharge cover 170 as compared with the outer sidewall 1702 and 1703. The outer sidewall 1702 and 1703 may be formed so as to define the outer periphery of the discharge cover 170.

In this case, a first sealing member 210 may be disposed between the inner sidewall 1701 and the second shaft support portion 152. The first sealing member 210 may be formed as an O-ring. Leakage of the refrigerant may be prevented by the first sealing member 210.

The inner sidewall 1701 and the second shaft support portion 152 may be disposed to at least partially overlap each other in the radial direction. In this embodiment, the inner sidewall 1701 may be disposed to make a surface contact with the outer circumferential surface of the second shaft support portion 152 at a radially outer side of the second shaft support portion 152.

More specifically, a fastening groove 1505 to which the upper end portion of the inner sidewall 1701 can be fastened may be formed on the bottom surface of the compression unit 100. The fastening groove 1505 may be disposed on the radially inner or outer periphery of the second shaft support portion 152.

In this embodiment, the fastening groove 1505 may be concavely formed on the bottom surface of the compression unit 100 around the radially outer periphery of the second shaft support portion 152.

As the upper end portion of the inner sidewall 1701 is inserted into the fastening groove 1505, leakage of the refrigerant from the third space V3 may be more reliably prevented.

The second shaft support portion 152 and the inner sidewall 1701 may be disposed to at least partially overlap each other in the radial direction. That is, the second shaft support portion 152 and the inner sidewall 1701 may be disposed so as to make a surface contact with each other in the radial direction.

In addition, a first sealing groove 152*a* and a second sealing groove 1701*a* for disposing the first sealing member 210 may be provided on the second shaft support portion 152 and the inner sidewall 1701.

That is, the first sealing groove 152*a* may be formed on the second shaft support portion 152 so as to be concave radially outward. In addition, the second sealing groove 1701*a* may be formed on the inner sidewall 1701 so as to be concave radially inward.

The first sealing groove 152*a* and the second sealing groove 1701*a* may be disposed at positions corresponding to each other. The first sealing member 210 may be disposed in a space defined by the first sealing groove 152*a* and the second sealing groove 1701*a*. Accordingly, the first sealing member 210 may more reliably prevent the refrigerant from leaking through a gap between the inner sidewall 1701 and the second shaft support portion 152.

The outer sidewall 1702 and 1703 of the discharge cover 170 may be coupled to the stepped surface 1502 and 1503 provided on the radially outer side of the lower end of the compression unit 100.

Specifically, the outer sidewall 1702 and 1703 may include a vertical portion 1702 corresponding to the side surface 1502 of the stepped surface 1502 and 1503, and a horizontal portion 1703 corresponding to a horizontal flat surface 1503 of the stepped surface 1502 and 1503. The horizontal portion 1703 may extend from one end of the vertical portion 1702 in the horizontal direction.

The side surface 1502 of the stepped surface 1502 and 1503 may contact the vertical portion 1702 of the outer sidewall 1702 and 1703, and the horizontal flat surface 1503 of the stepped surface 1502 and 1503 may contact the horizontal portion 1703 of the outer sidewall 1702 and 1703.

Accordingly, by increasing the contact area between the lower end of the compression unit 100 and the coupling portion of the discharge cover 170, leakage of the refrigerant may be reliably prevented.

Hereinafter, a coupling structure of the compression unit and the discharge cover according to the second embodiment will be described with reference to another drawing.

Figure 7:
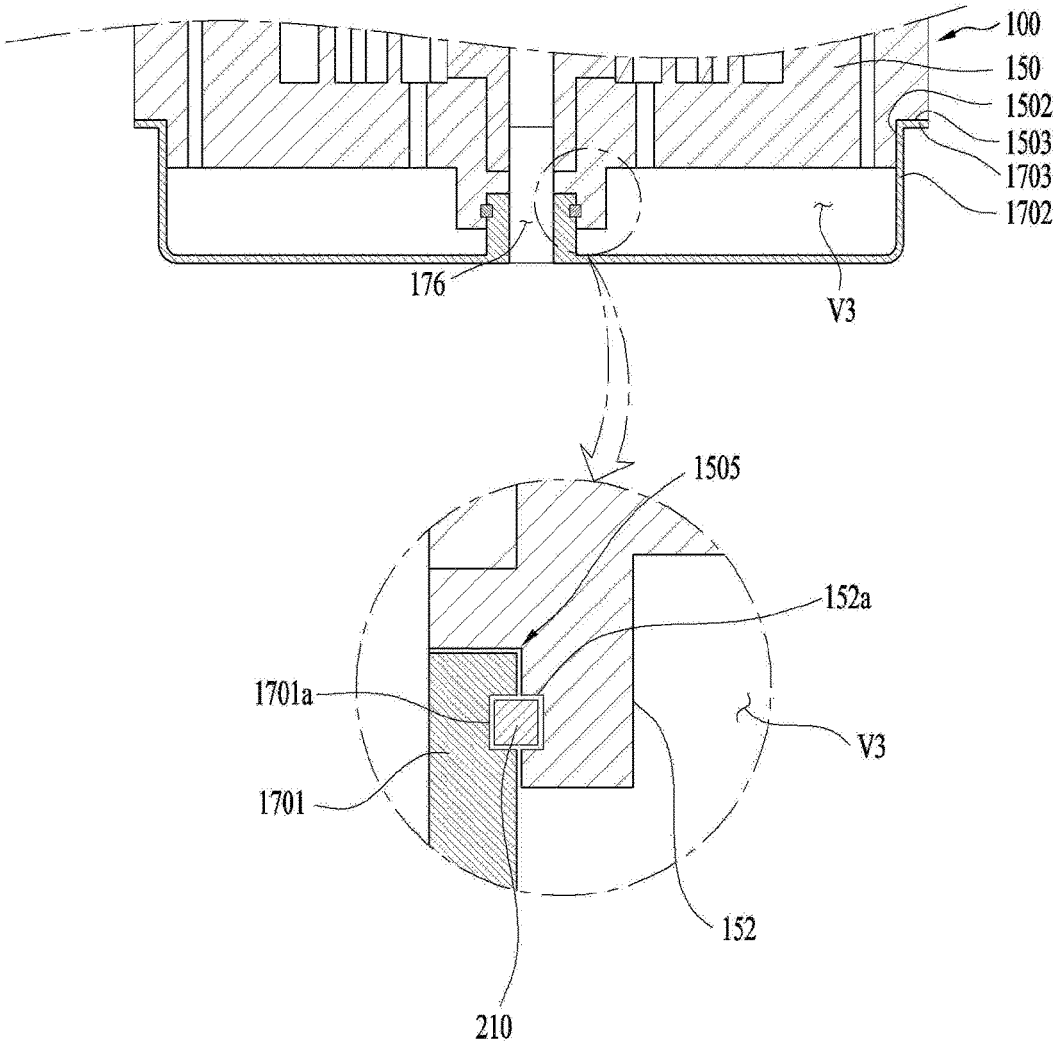
FIG. 7 is a conceptual diagram showing a coupling relationship between the compression unit and the discharge cover coupled to the lower end of the compression unit according to the second embodiment.

FIG. 7 is a conceptual diagram showing a coupling relationship between the compression unit and the discharge cover coupled to the lower end of the compression unit according to the second embodiment. Hereinafter, differences from the first embodiment will be mainly described, and description of components which are the same as those of the first embodiment will be omitted.

Referring to FIG. 7, the inner sidewall 1701 may be disposed so as to make a surface contact with the inner circumferential surface of the second shaft support portion 152 at the radially inner side of the second bearing receiving portion 152.

A fastening groove 1505 to which the upper end portion of the inner sidewall 1701 can be fastened may be formed on one surface of the compression unit 100. In this embodiment, the fastening groove 1505 may be concavely formed on the radially inner periphery of the second shaft support portion 152 at the lower end of the compression unit 100. For example, the fastening groove 1505 may be formed so as to be stepped upward from the radially inner periphery of the second shaft support portion 152.

A first sealing groove 152*a* may be formed on the second bearing 152 so as to be concave radially inward. In addition, a second sealing groove 1701*a* may be formed on the inner sidewall 1701 so as to be concave radially outward.

The first sealing groove 152*a* and the second sealing groove 1701*a* may be disposed at positions corresponding to each other. The first sealing member 210 may be disposed in a space defined by the first sealing groove 152*a* and the second sealing groove 1701*a*. The first sealing member 210 may be formed as an O-ring. Accordingly, leakage of the refrigerant may be more reliably prevented by the first sealing member 210.

Since the outer sidewall 1702 and 1703 is the same as that of the first embodiment, a detailed description thereof will be omitted. Hereinafter, a coupling structure of the compression unit and the discharge cover according to the third embodiment will be described with reference to another drawing.

Figure 8:
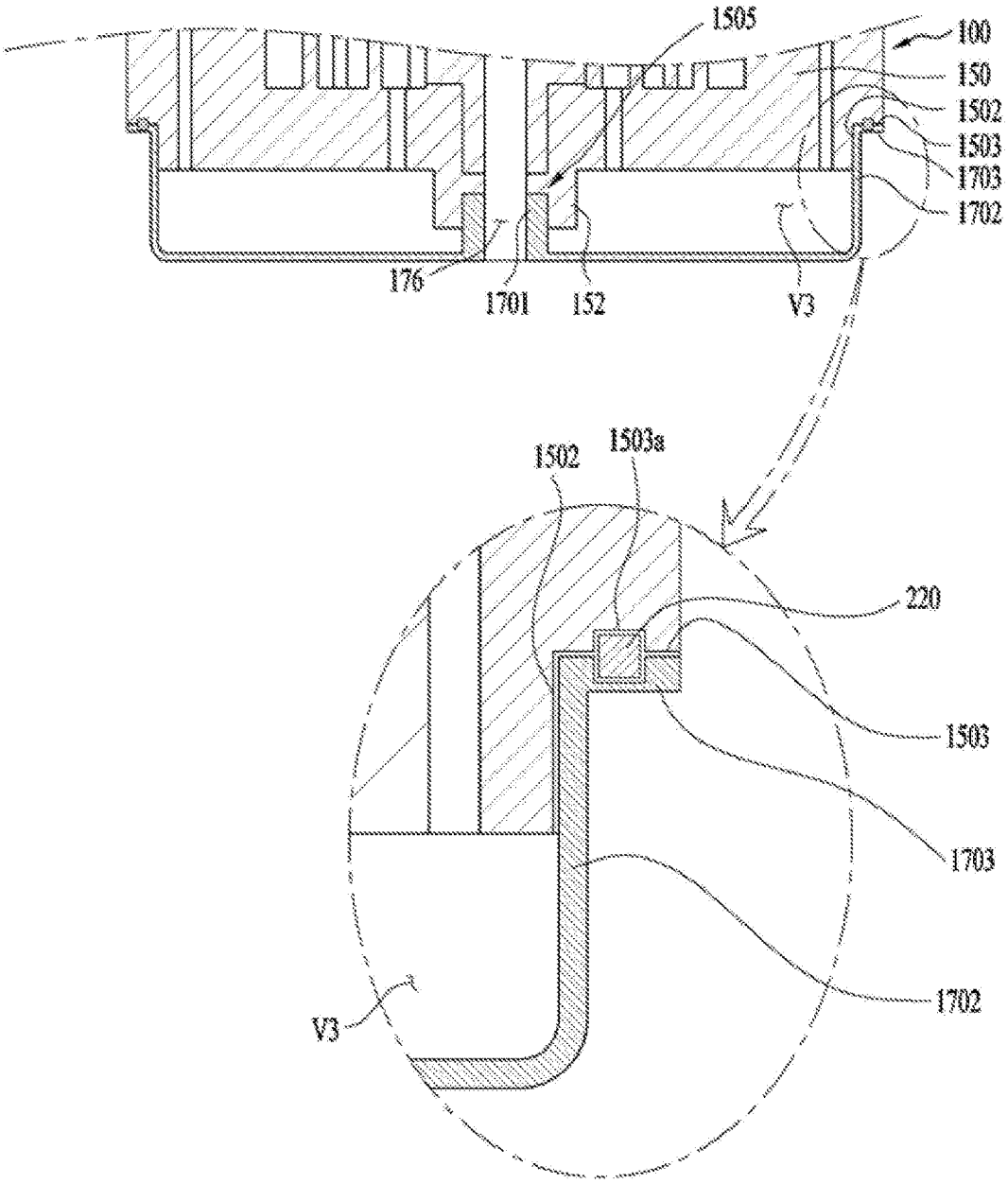
FIG. 8 is a conceptual diagram showing a coupling relationship between the compression unit and the discharge cover coupled to the lower end of the compression unit according to the third embodiment.

FIG. 8 is a conceptual diagram showing a coupling relationship between the compression unit and the discharge cover coupled to the lower end of the compression unit according to the third embodiment. Hereinafter, differences from the second embodiment will be mainly described, and description of components which are the same as those of the second embodiment will be omitted.

According to this embodiment, the first sealing member 210 may not be provided, but the structure of coupling between the inner sidewall 1701 of the discharge cover 170 and the second shaft support portion 152 may be the same as that of the second embodiment.

In this embodiment, the second sealing member 220 may be disposed between the outer sidewall 1702 and 1703 and the stepped surface 1502 and 1503. The second sealing member 220 may prevent the refrigerant from leaking through a gap between the outer sidewall 1702 and 1703 and the stepped surface 1502 and 1503.

Specifically, the outer sidewall 1702 and 1703 may include a vertical portion 1702 corresponding to the side surface 1502 of the stepped surface 1502 and 1503. The outer sidewall 1702 and 1703 may further include a horizontal portion 1703 corresponding to the horizontal flat surface 1503 of the stepped surface 1502 and 1503 and horizontally extending at the upper end of the vertical portion 1702.

Here, the second sealing member 220 may be disposed between the horizontal flat surface 1503 of the stepped surface 1502 and 1503 and the horizontal portion 1703. In addition, the first sealing member 220 may be formed as an O-ring.

More specifically, the horizontal flat surface 1503 of the stepped surface 1502 and 1503 and the horizontal portion 1703 may be provided with a third sealing groove 1503*a* and a fourth sealing groove 1703*a* for arranging the second sealing member 220.

That is, the third sealing groove 1503*a* may be concavely formed on the horizontal flat surface 1503 of the stepped surface 1502 and 1503. In addition, the fourth sealing groove 1703*a* may be concavely formed on the horizontal portion 1703. The third sealing groove and the fourth sealing groove may be concave in opposite directions.

The third sealing groove 1503*a* and the fourth sealing groove 1703*a* may be disposed to correspond to each other. A space for the arrangement of the second sealing member 220 may be defined by the third sealing groove 1503*a* and the fourth sealing groove 1703*a*.

Accordingly, leakage of the refrigerant through a gap between the outer sidewall 1702 and 1703 and the stepped surface 1502 and 1503 may be more reliably prevented by the second sealing member 220.

The horizontal flat surface 1503 of the stepped surface 1502 and 1503 and the horizontal portion 1703 may be disposed to at least partially overlap each other in the height direction of the compression unit 100.

Here, the horizontal flat surface 1503 of the stepped surface 1502 and 1503 and the horizontal portion 1703 may be provided in surface contact with each other. In addition, the side surface 1502 of the stepped surface 1502 and 1503 and the vertical portion 1702 may be disposed to make a surface contact with each other.

Leakage of the refrigerant may be reliably prevented by increasing the contact area between the coupling portions of the lower end of the compression unit 100 and the discharge cover 170.

Hereinafter, a coupling structure of the compression unit and the discharge cover according to the fourth embodiment will be described with reference to another drawing.

Figure 9:
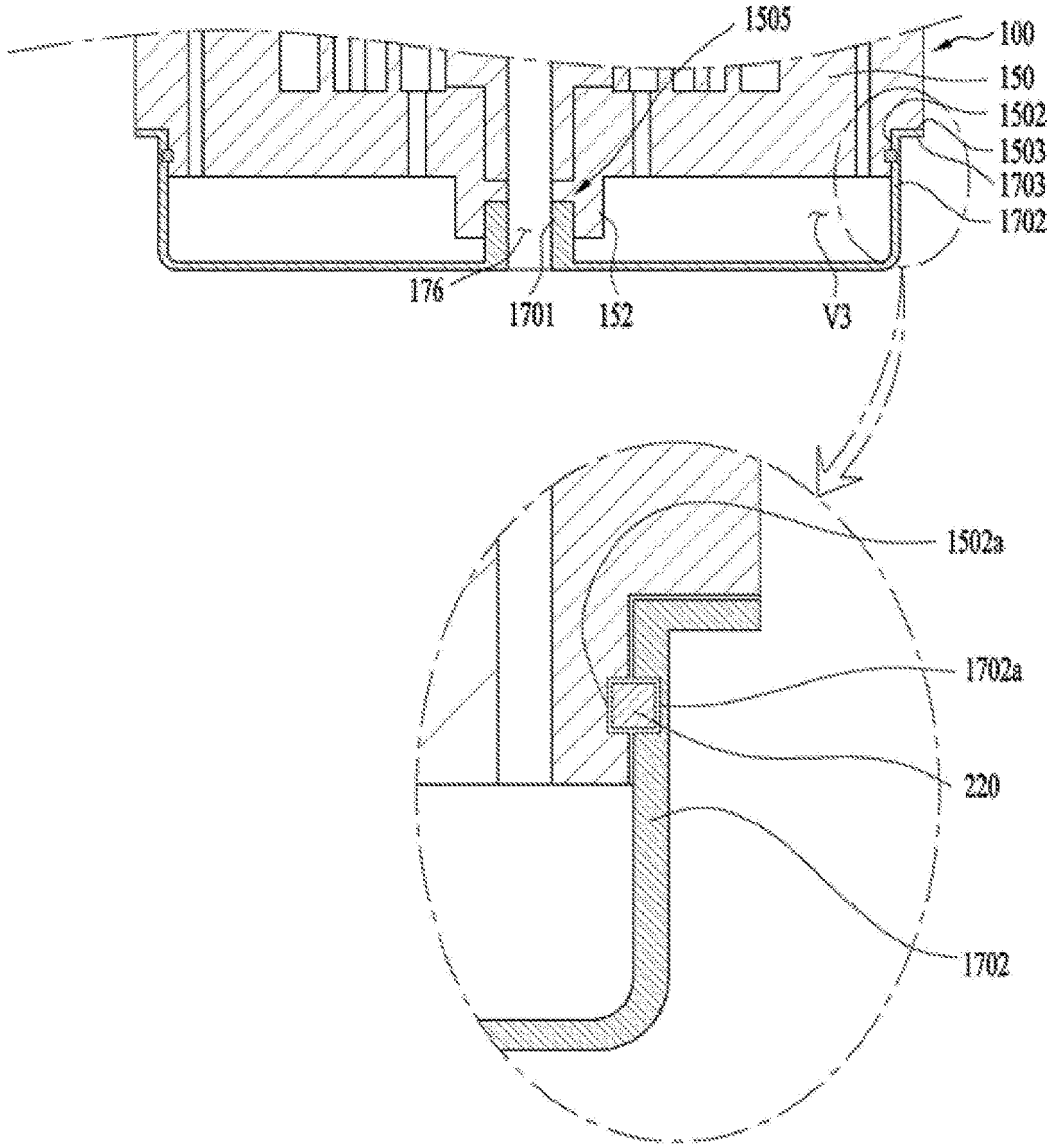
FIG. 9 is a conceptual diagram showing a coupling relationship between the compression unit and the discharge cover coupled to the lower end of the compression unit according to the fourth embodiment.

FIG. 9 is a conceptual diagram showing a coupling relationship between the compression unit and the discharge cover coupled to the lower end of the compression unit according to the fourth embodiment. Hereinafter, differences from the third embodiment will be mainly described, and description of components which are the same as those of the third embodiment will be omitted.

In this embodiment, the outer sidewall 1702 and 1703 may include a vertical portion 1702 corresponding to the side surface 1502 of the stepped surface 1502 and 1503 formed in the compression unit 100. The outer sidewall 1702 and 1703 may further include a horizontal portion 1703 corresponding to the horizontal flat surface 1503 of the stepped surface 1502 and 1503 and horizontally extending at the upper end of the vertical portion 1702.

In this embodiment, the second sealing member 220 may be disposed between the side surface 1502 of the stepped surface 1502 and 1503 and the vertical portion 1702. The second sealing member 220 may be formed as an O-ring.

Specifically, the side surface 1502 of the stepped surfaces 1502 and 1503 and the vertical portion 1702 may be provided with a fifth sealing groove 1502*a* and a six sealing groove 1702*a* formed at positions corresponding to each other for arrangement of the second sealing member 220.

That is, the fifth sealing groove 1502*a* may be formed on the side surface 1502 of the stepped surface 1502 and 1503 so as to be concave radially outward. In addition, the sixth sealing groove 1702*a* may be formed on the vertical portion 1702 so as to be concave radially inward.

The fifth sealing groove 1502*a* and the sixth sealing groove 1702*a* may be disposed so as to correspond to each other. A space for arrangement of the display unit 220 may be defined by the fifth sealing groove 1502*a* and the sixth sealing groove 1702*a*.

Accordingly, leakage of the refrigerant through a gap between the outer sidewall 1702 and 1703 and the stepped surface 1502 and 1503 may be more reliably prevented by the second sealing member 220.

The side surface 1502 of the stepped surfaces 1502 and 1503 and the vertical portion 1702 may be provided such that at least a part of the side surface 1502 overlaps the radial direction of the discharge cover 170.

Here, the side surface 1502 of the stepped surface 1502 and 1503 and the vertical portion 1702 may be provided in surface contact with each other. The horizontal flat surface 1503 of the stepped surface 1502 and 1503 and the horizontal portion 1703 may be disposed to make a surface contact with each other.

Leakage of the refrigerant may be reliably prevented by increasing the contact area between the coupling portions of the lower end of the compression unit 100 and the discharge cover 170.

Hereinafter, a coupling structure of the compression unit and the discharge cover according to the fifth embodiment will be described with reference to another drawing.

Figure 10:
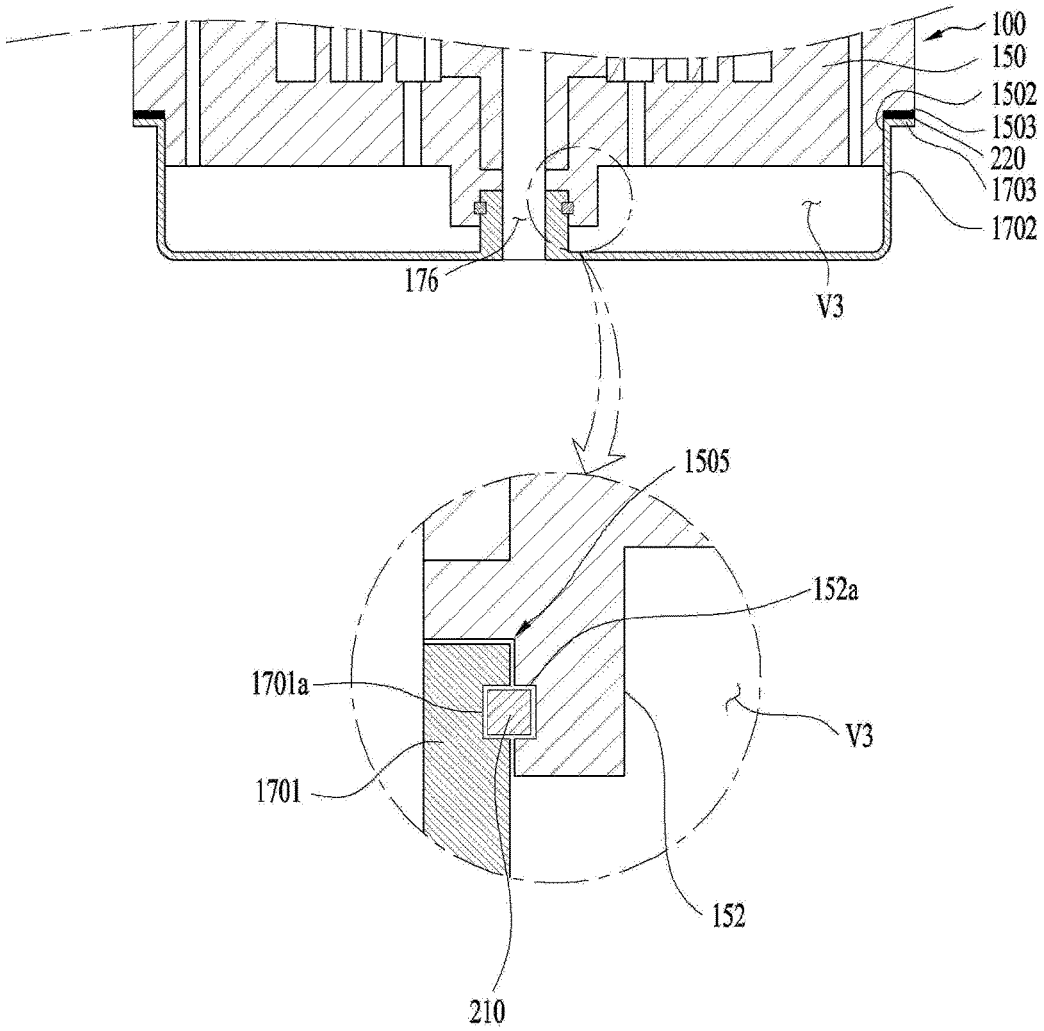
FIG. 10 is a conceptual diagram showing a coupling relationship between the compression unit and the discharge cover coupled to the lower end of the compression unit according to the fifth embodiment.

FIG. 10 is a conceptual diagram showing a coupling relationship between the compression unit and the discharge cover coupled to the lower end of the compression unit according to the fifth embodiment. Hereinafter, differences from the second embodiment will be mainly described, and description of components which are the same as those of the second embodiment will be omitted.

In this embodiment, the overall coupling structure of the compression unit 100 and the discharge cover 170 may be the same as that of the second embodiment.

However, unlike the second embodiment, this embodiment may include both the first sealing member 210 and the second sealing member 220.

That is, a first sealing groove 152*a* may be formed on the second bearing 152 so as to be concave radially inward. In addition, a second sealing groove 1701*a* may be formed in the inner sidewall 1701 so as to be concave radially outward.

The first sealing groove 152*a* and the second sealing groove 1701*a* may be disposed at positions corresponding to each other. The first sealing member 210 may be disposed in a space defined by the first sealing groove 152*a* and the second sealing groove 1701*a*. The first sealing member 210 may be formed as an O-ring.

According to this embodiment, the second sealing member 220 may further be disposed between the outer sidewall 1702 and 1703 and the stepped surface 1502 and 1503. The second sealing member 220 may be formed as a gasket.

The second sealing member 220 may prevent the refrigerant from leaking through a gap between the outer sidewall 1702 and 1703 and the stepped surface 1502 and 1503.

Specifically, the outer sidewall 1702 and 1703 may include a vertical portion 1702 corresponding to the side surface 1502 of the stepped surface 1502 and 1503. The outer sidewall 1702 and 1703 may further include a horizontal portion 1703 corresponding to the horizontal flat surface 1503 of the stepped surface 1502 and 1503 and horizontally extending at the upper end of the vertical portion 1702.

Here, the second sealing member 220 formed as a gasket may be disposed between the horizontal flat surface 1503 of the stepped surface 1502 and 1503 and the horizontal portion 1703.

As apparent from the above description, the present invention has effects as follows.

According to an embodiment of the present invention, a compressor may prevent oil circulating in the compressor from remaining in place, thereby preventing damage to the compressor.

According to an embodiment of the present invention, a compressor may prevent residual oil from remaining on a refrigerant passage in the compressor, thereby securing a sufficient space for flow of a refrigerant.

According to an embodiment of the present invention, a compressor may persistently maintain optimum compression efficiency by preventing residual oil from remaining in place.

According to an embodiment of the present invention, a compressor may prevent leakage of a compressed refrigerant.

According to an embodiment of the present invention, the efficiency of a compressor may be improved by preventing leakage of the refrigerant.

It will be apparent to those skilled in the art that various substitutions, modifications, and variations can be made in the present invention without departing from the spirit and scope of the invention. Thus, it is intended that the present invention cover the modifications and variations of this invention provided they come within the scope of the appended claims and their equivalents. Therefore, the present invention is not limited by the above-described embodiments and the accompanying drawings.

What is claimed is:

1. A compressor comprising:

a case comprising a refrigerant discharge pipe configured to discharge compressed refrigerant to an outside of the case;

a drive motor disposed in the case;

a rotary shaft disposed in the case and rotatably coupled to the drive motor;

a compression unit disposed in the case and configured to compress refrigerant, the compression unit comprising a shaft support portion through which at least a part of the rotary shaft passes and a stepped surface disposed at an outer side of the compression unit;

a discharge cover coupled to the compression unit and configured to guide refrigerant compressed by the compression unit toward the refrigerant discharge pipe; and a sealing member disposed between the compression unit and the discharge cover, wherein the discharge cover comprises an inner sidewall that is coupled to the shaft support portion and an outer sidewall that defines an outer periphery of the discharge cover, the outer sidewall being coupled to the stepped surface of the compression unit, wherein the shaft support portion has a fastening groove defined at an inner periphery of the shaft support portion, the fastening groove receiving the inner sidewall of the discharge cover such that the shaft support portion covers at least a part of the inner sidewall of the discharge cover in an axial direction of the compression unit, wherein the sealing member comprises:

a first sealing member disposed between the inner sidewall of the discharge cover and the shaft support portion, and a second sealing member disposed between the outer sidewall of the discharge cover and the stepped surface of the compression unit, wherein the shaft support portion defines a first sealing groove in the fastening groove, and the inner sidewall of the discharge cover defines a second sealing groove facing the first sealing groove in the fastening groove, and wherein the first sealing groove and the second sealing groove define a first sealing space that receives the first sealing member.

2. The compressor of claim 1, wherein the stepped surface of the compression unit comprises a side surface that extends along the axial direction of the compression unit, and a horizontal flat surface that extends radially outward from the side surface of the stepped surface, wherein the outer sidewall of the discharge cover comprises:

a vertical portion that faces the side surface of the stepped surface; and a horizontal portion that extends radially outward from one end of the vertical portion and that faces the horizontal flat surface of the stepped surface, and wherein the second sealing member is disposed between the horizontal flat surface of the stepped surface and the horizontal portion of the outer sidewall of the discharge cover.

3. The compressor of claim 2, wherein the horizontal flat surface and the horizontal portion at least partially overlap each other in a radial direction of the compression unit.

4. The compressor of claim 1, wherein the stepped surface of the compression unit comprises a side surface that extends along the axial direction of the compression unit, and a horizontal flat surface that extends radially outward from the side surface of the stepped surface, wherein the outer sidewall of the discharge cover comprises:

a vertical portion that faces the side surface of the stepped surface; and a horizontal portion that extends radially outward from an upper end of the vertical portion and that faces the horizontal flat surface of the stepped surface, wherein the second sealing member is disposed between the side surface of the stepped surface and the vertical portion of the outer sidewall of the discharge cover.

5. The compressor of claim 4, wherein the side surface of the stepped surface and the vertical portion of the outer sidewall at least partially overlap each other in the axial direction of the compression unit.

6. The compressor of claim 1, wherein the fastening groove is recessed upward from at a lower end surface of the shaft support portion.

7. The compressor of claim 1, wherein a rotational axis of the rotary shaft passes through the fastening groove.

8. The compressor of claim 1, wherein the inner periphery of the shaft support portion surrounds at least the part of the inner sidewall of the discharge cover.

9. The compressor of claim 1, wherein the inner sidewall of the discharge cover is disposed radially inward relative to the inner periphery of the shaft support portion.

10. The compressor of claim 1, wherein the second sealing groove is defined at an outer surface of the inner sidewall of the discharge cover, the outer surface facing the inner periphery of the shaft support portion.

11. The compressor of claim 10, wherein the first sealing groove is recessed radially outward from the inner periphery of the shaft support portion, and wherein the second sealing groove is recessed inward from the outer surface of the inner sidewall of the discharge cover.

* * * * *